United States Patent [19]

Beck, Jr. et al.

[11] Patent Number: 4,584,926

[45] Date of Patent: Apr. 29, 1986

[54] SWASHPLATE LEVELING AND HOLDDOWN DEVICE

[75] Inventors: Richard Beck, Jr.; Joseph E. Louis, both of Ames, Iowa

[73] Assignee: Sundstrand Corporation, Rockford, Ill.

[21] Appl. No.: 680,439

[22] Filed: Dec. 11, 1984

[51] Int. Cl.[4] ..... F01B 13/04

[52] U.S. Cl. ..... 92/12.2; 91/505; 91/506; 417/222

[58] Field of Search ..... 417/222; 92/12.2, 71; 91/504–506, 499

[56] References Cited

U.S. PATENT DOCUMENTS

| | | | |
|---|---|---|---|
| 3,359,727 | 12/1967 | Hann et al. | 60/389 |
| 3,384,028 | 5/1968 | Thoma | 91/485 |
| 4,142,452 | 3/1979 | Forster et al. | 91/506 |
| 4,283,962 | 8/1981 | Forster | 91/505 X |

*Primary Examiner*—William L. Freeh

*Assistant Examiner*—Paul F. Neils

*Attorney, Agent, or Firm*—James A. Wanner; Ted. E. Killingsworth; Harold A. Williamson

[57] ABSTRACT

The invention relates to a swashplate leveling and holddown mechanism wherein an axially sliding leveling mechanism is biased into engagement with a swashplate of an axial piston variable displacement hydraulic unit to position the swashplate in a zero displacement position when there is no control input to the hydraulic unit. The leveling mechanism has a pair of contact points, one positioned on each side of the swashplate tilt axis in a manner that both contact points positively engage the swashplate when it is centered to its zero displacement position. Such mechanism requires no spring adjustment and has no backlash. Furthermore, the axial bias on the leveling mechanism helps seat the swashplate in its support bearings. Utilized in conjunction with the leveling mechanism is an axially biased control input which operates on the opposite side of the swashplate to further hold the swashplate in its support bearings.

29 Claims, 7 Drawing Figures

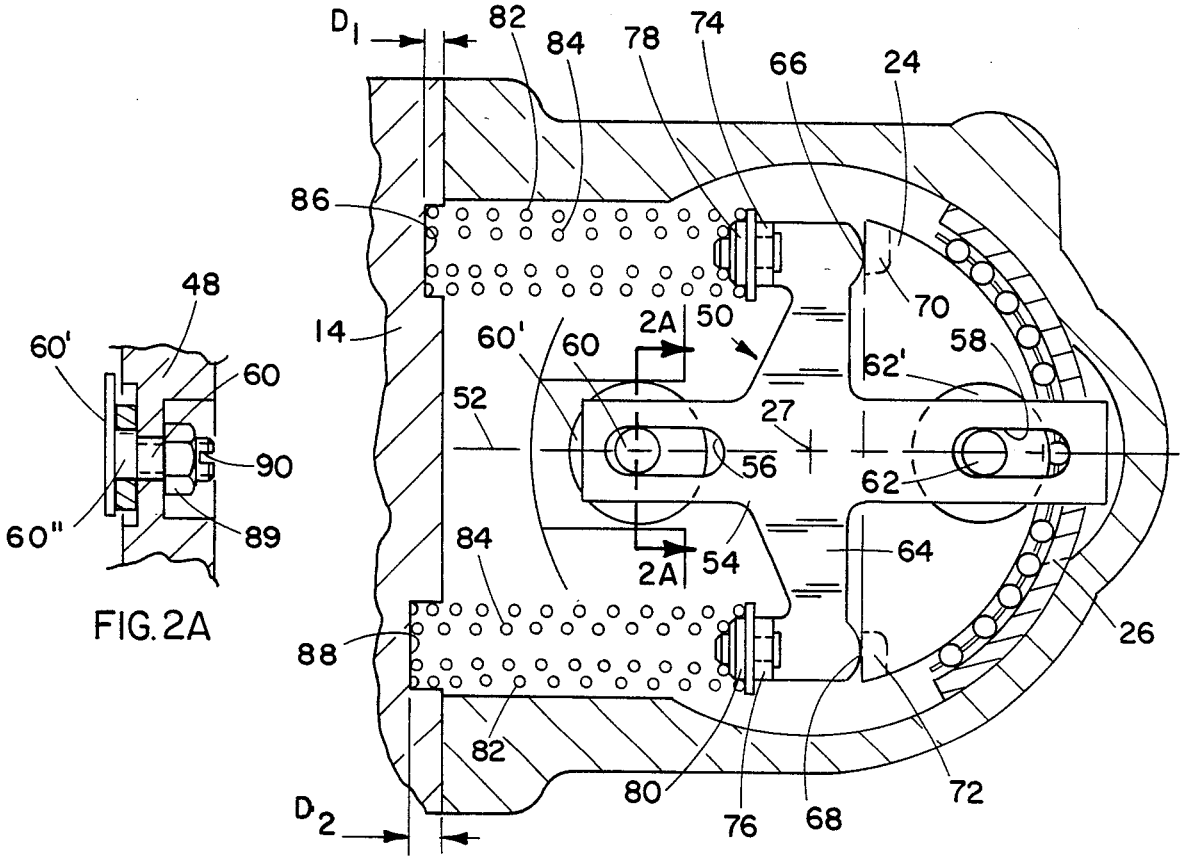
FIG. 2A
FIG. 2
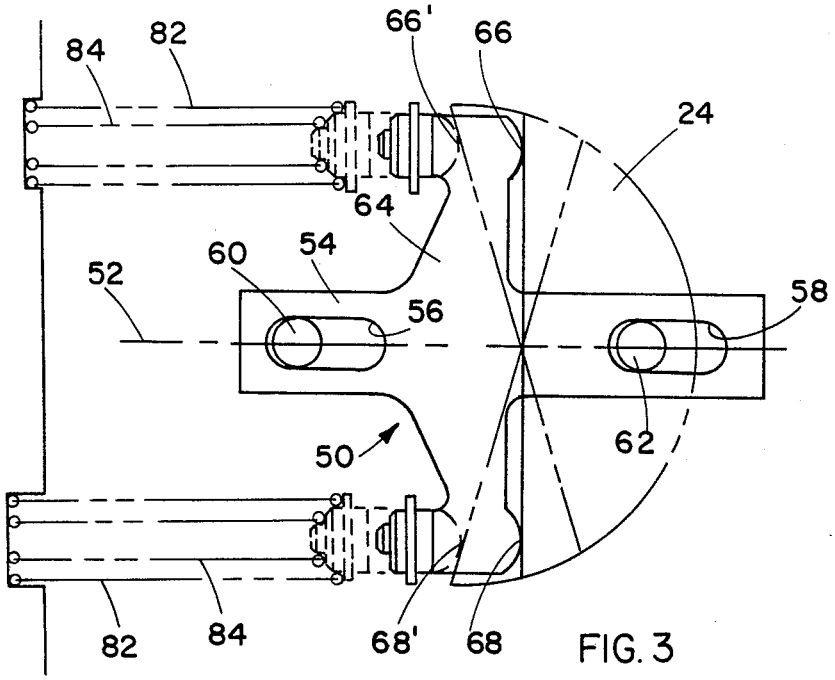
FIG. 3

SWASHPLATE LEVELING AND HOLDDOWN DEVICE

FIELD OF THE INVENTION

In variable displacement hydraulic units, especially pumps of either the single flow direction or the reversible flow type, it is desirable to have means which positively locate the swashplate in a zero displacement position when there is no control input to move the swashplate to a stroking position. The present invention provides a simple and compact means for leveling the swashplate, that is holding it in a zero displacement position. Furthermore, the mechanism of the present invention may also be used as a holddown device for the swashplate to help retain the swashplate in its bearing seat.

BACKGROUND OF THE INVENTION

Many hydraulic units of the variable displacement type have a rotating cylinder block with pistons axially movable therein. The displacement of the hydraulic unit is proportional to the stroke of the pistons within the cylinder block. Where the hydraulic unit is of the axial piston type, the pistons or piston slippers engage a tiltable swashplate to vary the stroke of the pistons. When the swashplate is perpendicular to the axis of the cylinder block, the swashplate is in the neutral or a zero displacement position and the hydraulic unit has no output.

In order to maintain the swashplate in its zero displacement position when no control forces are applied thereto, various swashplate centering mechanisms have been utilized. Generally such centering mechanisms are a plurality of springs which apply opposite biasing forces on the swashplate at points spaced from the tilt axis of the swashplate. Hann et al U.S. Pat. No. 3,359,727 issued Dec. 26, 1967 shows the centering springs to be placed within hydraulic servo mechanisms which are utilized to control the tilt of the swashplate. Such springs may be of a short unstressed length or have a length limiting means to prevent engagement of the spring with the servo piston until the swashplate tilts toward the servo cylinder containing the spring. This, however, requires, very accurate spring lengths or adjustment thereof to minimize backlash and insure that the centering force of a given spring does not start until the swashplate is tilted toward that spring but still assures that the spring starts to act on the swashplate exactly when the swashplate is in the zero displacement position.

Another version of a swashplate leveling and holddown device is taught in Forster et al U.S. Pat. No. 4,142,452 issued Mar. 6, 1979 teaching a cradle type swashplate resting in a roller bearing pocket and having four swashplate positioning devices located in the corners of the hydraulic unit housing. In one embodiment of Forster, all four mechanisms are servo pistons with prestressed springs such as mentioned above. In another embodiment of Forster, two of the locating mechanisms, located on one side of the tilt axis of the swashplate, are servo units while the two locating mechanisms located on the opposite side of the tilt axis are spring units. Since the spring units are only on one side of the tilt axis, the spring units cannot be used as a leveling device but can only counterbalance the axial biasing force of the servo cylinders on the opposite side of the tilt axis. Even in the first embodiment where the four spring servos apply an axial holddown force on the cradle swashplate, that is to hold the cradle swashplate against its roller bearings, the four springs must be critically dimensioned and adjusted during assembly to provide a spring centering function on the swashplate.

In the prior art structures, such as Forster, in order to have counter-balancing spring centering, it is quite critical that the springs have the same axial force characteristics which requires adjustment and the associated extra parts and assembly steps. Such adjustment must compensate for leveling and backlash. Without complete backlash adjustment, accurate leveling cannot be achieved. Furthermore, use causes a spring to lose its spring rate or take a set and this characteristic alters any previous adjustment. Even though the spring rate loss characteristic may only be a few percent of the total force supplied by the spring, any difference in spring rate loss has a major effect upon the centering forces of the spring and thus prevents swashplate from centering at its zero displacement position.

SUMMARY OF THE INVENTION

The present invention is directed to a centering mechanism for the swashplate which is positive acting in the neutral position so as to assure that the swashplate is centered to its zero displacement position, which normally is perpendicular to the cylinder block axis.

It is the object of the present invention that the positive centering mechanism may optionally provide a swashplate holddown force to keep the swashplate properly seated in its bearings, particularly if the swashplate is of the cradle type. It is yet a further object of the present invention to have the positive centering mechanism cooperate with an axially biased swashplate positioning mechanism to provide an axial holddown force for a cradle type swashplate.

It is of further object to provide the positive centering mechanism for a swashplate which is compact and does not require critical adjustment of the springs and elminates backlash in the leveling system.

Still another object of the present invention to provide a positive acting leveling mechanism that is physically located on only one side of the cylinder block housing with the leveling mechanism located on a removable side cover to facilitate assembly or adjustment.

It is also another object of the present invention to provide an adjustment mechanism to position the centering mechanism in an original neutral or zero displacement position which will not vary as spring rates decrease during use, repair or replacement.

Also an object of the present invention is to provide a swashplate centering mechanism for a variable displacement hydraulic unit comprising a housing, a cylinder block rotatable in the housing about an axial center line and having pistons axially movable therein with the swashplate tiltable about a transverse axis perpendicular to the centerline and having a cam surface engageable by the pistons to control the stroke of the pistons within the cylinder block. A centering mechanism comprising a cam member is provided and is axially movable along a cam line parallel to the axial centerline, the cam having a pair of spaced apart swashplate contact points one disposed on each side of the transverse axis, and biasing means to bias the cam member toward the swashplate whereby both of the cam contact points contact the swashplate when it is in a zero displacement position.

It is a further object of the present invention to provide a swashplate holddown means for a variable displacement hydraulic unit comprising a housing, a cylinder block rotatable in said housing about an axial centerline and having pistons axially moveable therein, a swashplate and tiltable about a transverse axis perpendicular to the centerline and supported by bearing means on said housing, the swashplate having a cam surface engageable by said pistons to control the stroke of said pistons within the cylinder block, and wherein a displacement control means is attached to said swashplate to vary the tilt of the swashplate to control the axial positions of said pistons in the cylinder block. The holddown means comprises mounting means locating the displacement control means on one side of said cylinder block and permitting axial movement parallel to said centerline of at least that portion of the displacement control means attached to the swashplate, spring means axially biasing the portion of the displacement control means toward the swashplate to apply a first axial biasing force on a first side of the swashplate, and swashplate centering means located on the opposite side of the cylinder block applying a second axial biasing force on the swashplate parallel to the first biasing force and on the opposite side of the swashplate.

BRIEF DESCRIPTION OF THE DRAWINGS

FIG. 2 is a sectional view taken along lines 2—2 of FIG. 1 and showing the positive centering and holddown mechanism and its cooperation with the cradle swashplate.

FIG. 2A is a partial sectional view taken along lines 2A—2A of FIG. 2 showing an accentric adjustment mechanism which may be used.

FIG. 3 is a schematic view showing the cooperation of the leveling mechanism with the swashplate as the swashplate moves from a centered position.

BRIEF DESCRIPTION OF THE PREFERRED EMBODIMENTS

Figure 1:
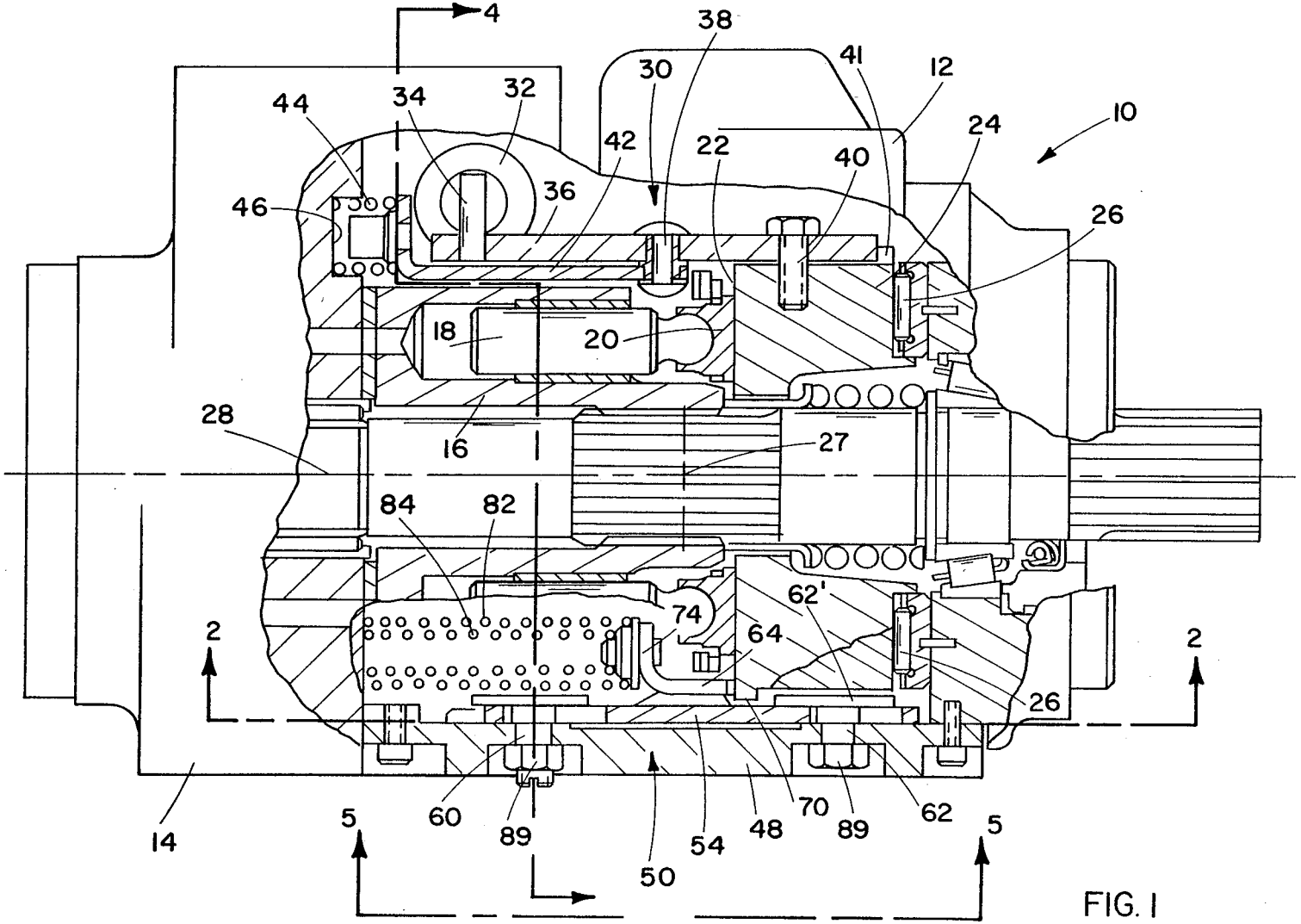
FIG. 1 is a sectional view of the hydraulic unit having the positive swashplate centering and holddown mechanism of the present invention.

FIG. 1 shows an axial piston hydraulic unit 10 having the cylinder block housing 12 and an end cap 14. Located within the housing 12 is a rotatable cylinder block 16 having plurality of axially sliding pistons 18 located therein. Each piston has a slipper 20 which engages a planner front cam surface 22 of a cradle type swashplate 24. The swashplate 24 is mounted on a pair of semi-circular roller bearings 26 for tiltable movement about a transverse swashplate axis 27, which is perpendicular to a cylinder block axis or centerline 28. Such axial piston hydraulic units using a cradle swashplate are well known and the particular structure of the parts heretofore described are not material to the present invention.

Located in the upper portion of FIG. 1 is a displacement control input 30 having a pair of servo cylinders 32 (only one shown) acting on a pin 34 to move a control lever 36 having a central pin 38. A bolt 40 wedges the lever 36 into a tapered groove 41 on the side of the swashplate 24. With the lever arm 36 secured to the side of the swashplate 24, the control lever 36 must follow the same tilting or pivotal movement of the swashplate 24 within its bearings 26. The swashplate is actually a portion of a cylinder where in the center of pivot of the swashplate 24 is the swashplate axis 27 which is located forward of the front face of the swashplate forming the cam surface 22 for the piston slippers 20. Thus pivotal movement of the swashplate 24 also results in identical pivotal movement of the control lever 36 about the swashplate pivot axis 27. The central pin 38 is located as close to the pivot axis 27 as possible although, as seen in FIG. 1, it is spaced slightly forward of the axis 27 to prevent interference with other parts of the hydraulic unit such as the piston slippers 20 or the slipper holddown structure. Thus, pin 38, being substantially on axis 27, has very little movement induced by pivotal movement of the control arm 36 when a control input is applied on servo pin 34. The particular control input is not of particular importance, and the input could also be manual or electrical in place of the hydraulic input provided by the servo cylinders 32.

Central pin 38 is secured to an angled bracket 42 which is axially biased by a spring 44 seated in a pocket 46 of the end cap 14. The axial biasing force is applied through bracket 42, pin 38, lever 36 and bolt 40 to the upper side of swashplate 24 as shown in FIG. 1. This provides a holddown force on the swashplate 24 biasing the swashplate against the upper of the two roller bearings 26. It is envisioned that the leveling features of the present invention can be used on not only the cradle type swashplate 24 as shown on the drawings, but is also equally applicable to a trunion mounted_ or other mounted swashplate. However, where a cradle type swashplate is used, the centering mechanism of the present invention applies a holddown force on the opposite side of the swashplate 24 which cooperates with the holddown force of spring 44 as just described to keep the cradle type swashplate 24 seated in the bearings 26.

Now referring to FIGS. 1, 2 and 3, the preferred forms of centering mechanism will now be described. Located at the lower side of the housing as viewed through FIG. 1 is a side cover 48 which mounts the centering mechanism. The centering mechanism comprises a cam member 50 which is actually movable along a cam axis 52 parallel to the cylinder block axial centerline 28. The cam 50 includes a leg portion 54 having a pair of mounting slots 56 and 58 positioned about mounting pins 60 and 62 respectively. The cam 50 is furthermore provided with a transverse member or crossbar 64 having a pair of wings which extend perpendicular to the cam axis 52. At the outer ends of the crossbar 64 is a pair of rounded contact points 66 and 68 designed to engage the front surface of the cam 24. The two contact points 66 and 68 are in a plane perpendicular to cam axis 52. While the contact point 66 and 68 engage two of the four corners of a rectangular faced swashplate, the cradle swashplate may also be provided with two bosses 70 and 72, the latter of which being shown in both FIGS. 1 and 2, which extend outwardly from the body of the swashplate 24 to form a planar surface which is engaged by contact points 66 and 68. This permits a narrower swashplate body to provide clearance for other elements. On the crossbar 64 and opposite the contact point 66 and 68 are angled portions 74 and 76 which have riveted thereto spring seats 78 and 80. Each of the spring seats provide a mounting for an outer spring 82 and an optional inner spring 84. Springs 82 and 84 may abut flat against the face of the end cap 14 as in FIG. 1 or can sit in pockets 86 and 88 formed in the end cap 14 as in FIG. 2. In the preferred form of practicing in the invention, one of the pockets such as 88 is deeper than the other pocket 86 for reasons to be explained later.

The springs 82, and also the optional springs 84 when utilized, provide an axial biasing force to the right as seen in FIGS. 1, 2, and 3, on the cam member 50, to bring at least one of the contact points 66 or 68 into engagement with the swashplate 24. Since the axis 52 of the cam member is parallel to the axis 28 of the cylinder block, the cam 50 can move to the right until both contact points 66 and 68 engage the swashplate 24, at which time the planar cam surface 22 of the swashplate 24 upon which the piston slippers 20 ride is perpendicular to the cylinder block 16. Under such conditions herein referred as a zero displacement condition, rotation of the cylinder block does not generate flow if the hydraulic unit 10 is a pump and produces zero torque output if the hydraulic unit 10 is a motor.

In FIG. 3, the swashplate 24 and the cam 50 are shown in solid lines when in the zero displacement position. However, when the swashplate 24 is tilted counterclockwise about axis 27 due to the servo 32 or other input, the upper portion of the front face of the cam 24, which is engagement with the contact point 66, forces the cam 50 to move to the left against the bias of both the upper and lower springs 82 and 84. This left position is represented by the contact point 66'. Since the whole cam 50 moves to the left, the lower contact point, now 68', is no longer engagement with the lower portion of the swashplate 24 which has tilted to the right. Clockwise rotation of the swashplate 24, such as a reverse mode of operation, causes the lower portion of the swashplate 24 to move the cam 50 again to the left, but with the lower contact point 68' now in engagement with the swashplate 24. When the swashplate 24 is in either the clockwise or counterclockwise position as described above, the cam 50 is still biased toward the right by the springs 82 and 84 so as to bias the swashplate 24 toward a centering position, that is with the piston slipper riding cam surface 22 to be perpendicular to the axis 28 of the cylinder block 16 when no input control forces are applied to the swashplate 24.

In such centered or neutral position, both contact points 66 and 68 engage the front surface of the swashplate 24 to positively retain the swashplate 24 in the zero displacement position. Since the contact point 66 and 68 are perpendicular to the cam axis 52 and the centerline 28, and since they are both part of the cam 50 which can only move along the cam axis 52, there is no possible relative movement between the contact points 66 and 68. Thus, the swashplate 24 is positively centered to the zero displacement position. If, for some reason, one set of the springs has a different biasing force than the other set of springs, this cannot cause tilt of the cam 50 about cam axis 52 (once established).

Since the cam member 50 moves only along cam axis 52 and is not subject to tilt, several embodiments are envisioned to provide adjustment of the cam axis 52 to take up manufacturing tolerances and assure that the cam axis 52 is parallel to the centerline 28 of hydraulic unit 10. In the embodiment taught in FIGS. 1, 2, and 3, the pins 60 and 62 are of a diameter substantially equal to the width of the slots 56 and 58 so that the edges of the slots 56 and 58 engage both sides of the pins. The pin 60 and 62 have enlarged 10 heads 60' and 62' respectively which trap the axial member 54 against the inside face of the side cover 48 when nuts 89 are tightened on threaded portions of the pins 60 and 62. However, as best seen in FIG. 2A, a central portion 60" of one of the pins 60 is eccentric to the pin 60 so that rotation of the pin 60 can move the cam leg portion 54 vertically as seen in FIG. 2, since the eccentric portion 60" engages the slot 56. Thus, even if the pins 60 and 62 are not in perfect parallel alignment with the centerline 28, rotation of the pin 60 adjusts the cam axis 52 until a parallel relationship is achieved between the cam axis 52 and the centerline 28. Once each parallel relationship established, it is assured that the contact points 66 and 68 of the cam 50 positively position the cam 24 at zero displacement condition when there are no outside control forces applied to the swashplate 24. For the adjustment of the eccentric 60", the pin 60 is provided with the slot 90 which can be used to rotate the pin 60 when a securing nut 89 is loosened. The outer end of the pin 60 is intended to be flush or recessed relative to the outer surface of the sideplate 48 as shown in FIG. 2A. The adjustment mechanism shown in FIG. 1 extends beyond the outer face solely for clarity purposes. While it is only necessary for one of the pins 60 or 62 to have the eccentric 60" for adjustment of the cam line 52, it is also contemplated that both pins 60 and 62 may be provided with eccentric portions to aid in adjustment of the cam axis 52.

Figure 5A:
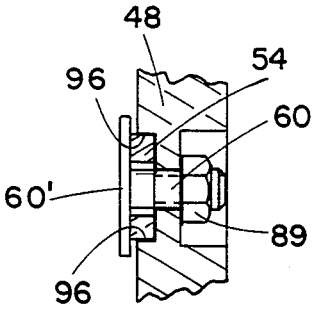
FIG. 5A is a sectional view taken along line 5A—5A of FIG. 5 showing mounting of the leveling mechanism in a slot of a rotatable side cover.
Figure 5:
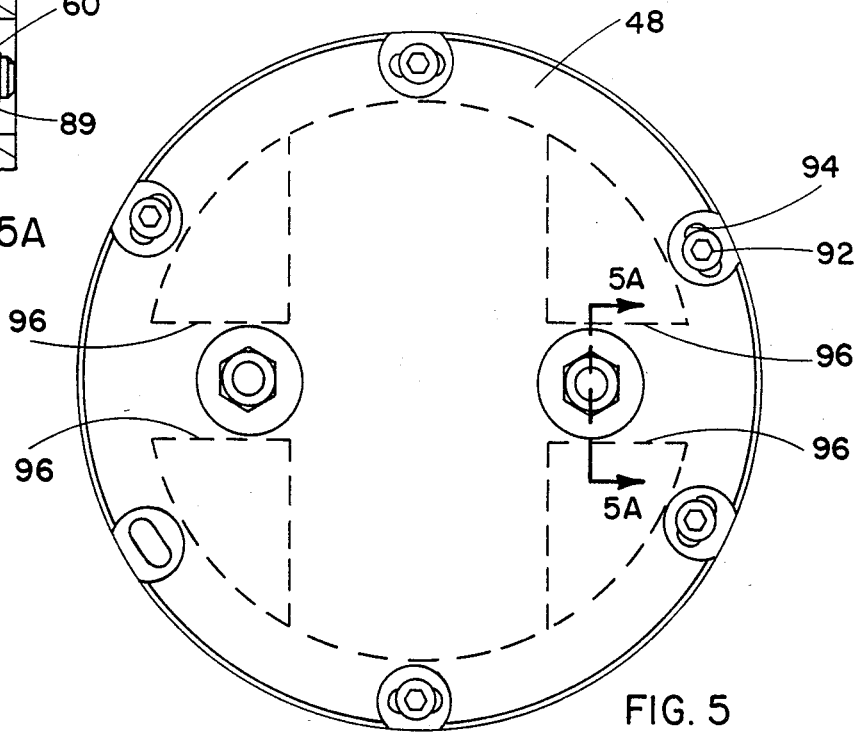
FIG. 5 is a side view taken along line 5—5 of FIG. 1 showing a rotatable side cover which may be used to mount and adjust the leveling mechanism.

FIGS. 5 and 5A show another embodiment for adjusting of the cam axis 52. While the side cover 48 is shown as circular, other shapes may be utilized. However, the circular form has a particular advantage when the side cover mounting bolts 92 pass through arcuate slots 94 in the circular side plate 48. By loosening the side cover bolts 92, the side cover 48 may be rotated slightly clockwise or counterclockwise relative to the housing 12. The side cover 48 may be provided with internal edges 96 which form slots that trap the cam leg portion 54. Thus, as the side cover 48 is rotated, the cam axis 52 is adjusted until the parallel with the centerline 28. With such side cover adjustment mechanism, the pins 60 do not need the eccentric 60" since double adjustment mechanism would be redundant. Thus, the threaded pins 60 with nuts 89 could be placed with rivets. Since the edges 96 form slots which trap the cam leg 54, the pin slots 56 and 58 are slightly wider than the diameter of the pins 60 and 62 to prevent any interference fit.

Figure 4:
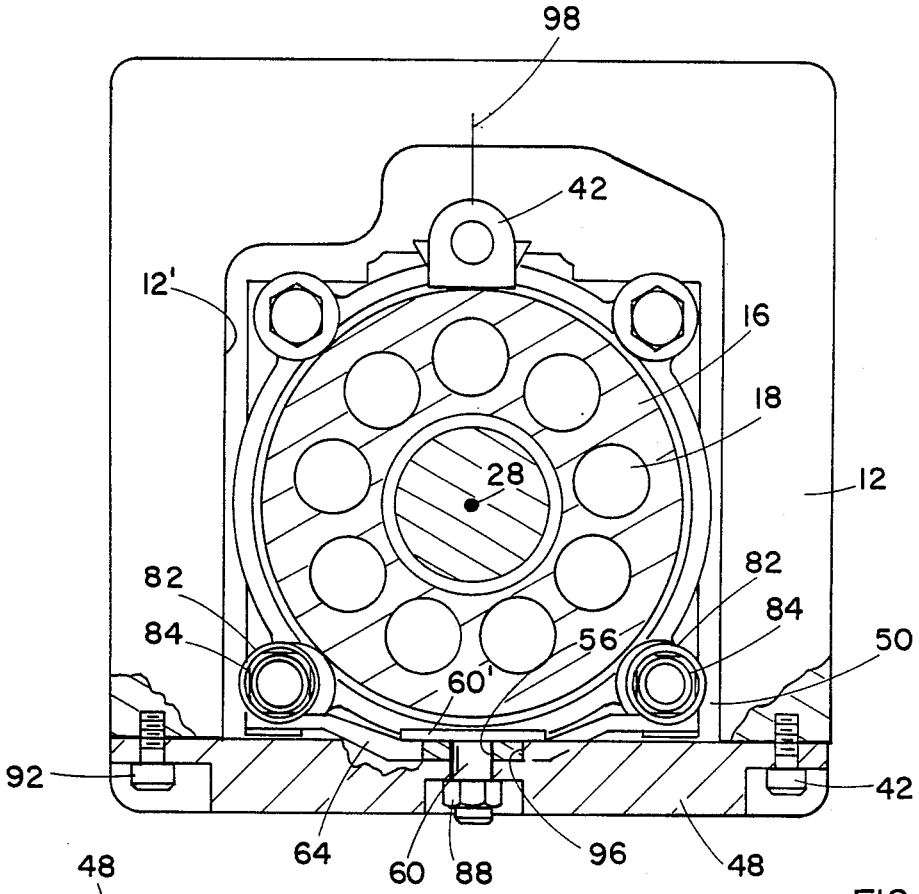
FIG. 4 is a sectional view taken along line 4—4 of FIG. 1 showing the mounting of the leveling mechanism relative to the side cover.

FIG. 4, taken as a cross section through the hydraulic unit, shows the compact space saving relationship of the cam 50 relative to a rectangular internal cavity 12' of the housing 12 circumscribing the rotating cylinder block 16. As stated earlier, the cam 50 is held snug against the side cover 48 by the pins 60 and 62 and their enlarged heads 60 and 62: In FIG. 4, which is the version of FIG. 5 utilizing the edges 96 to trap the cam leg portion 54, the cam 50 may be mounted slightly recessed into the slots formed by edges 96 of side cover 48. In the version contemplated in FIGS. 1, 2, and 3, the cam leg 54 would be mounted flush with the inside surface of the side cover 48, but the cover 48 without the slots would be of less thickness. Utilizing either embodiment, the cam leg 54 is located along a transverse centerline 98 of the housing 12 where there is little clearance between the rotating cylinder block 16 and the side cover 48. However, since the leg portion 54 of the cam 50 is flat, it occupies very little space in this transverse dimension. The wings of the crossbar 64 are bent inwardly as the wings extend outwardly from the housing transverse centerline 98. However, the clearance between the rotating cylinder block 16 and the corners of the housing cavity 12' is considerably greater than the radial clearance along transverse centerline 98. This permits the springs 82 and 84, whose diameter is considerably greater than the width of the cam leg 54, to be located in the corners where there is greater clearance. While this is most convenient from a clearance standpoint, other designs have been tested using two springs located closer to the transverse centerline 98, and it is also possible to use a single spring on the cam axis 52, although this necessitates a greater width to the housing 12.

Not only do the springs 82 and 84 provide the biasing force for the cam 50 to generate the centering force to the swashplate 24, the same spring forces can also be used for swashplate holddown biasing the swashplate 24 against the lower bearing 26 as seen in FIG. 1. As stated above when describing the holddown function of the upper spring 44, this is particularly important when a cradle type swashplate is used. With the embodiment taught in the drawings, that is with the leveling cam 50 located on one side of the cylinder block 16 and the control mechanism 30 located on the opposite side of the cylinder block, the centering springs 82 and 84, along with the control spring 44, provide axial biasing forces on both sides of the cradle swashplate 24 to keep it securely seated against both bearings 26.

It is also contemplated that the springs 82 and 84 on one side of the cam 50 are of substantially the same length as the springs 82 and 84 on the other side of the cam 50, but are seated in a pocket 86 of a depth $D_1$ different than depth $D_2$ of pocket 88 so as to provide a different prestress on the springs on one side of the cam 50 as compared to the opposite side. This different prestress of the springs provides a slight rotational canting action on the cam 50 at the neutral position so that one side of the slots 56 and 58 positively engage opposite sides of the pins 60 and 62 (in the FIG. 2 embodiment) or that the cam leg 54 engages diagonally opposite edges 96 of the slots formed in the rotational side cover 48 (in the FIG. 5 embodiment). This assures that any manufacturing clearance, between the slots and the pins in FIG. 2 or the cam leg 54 and the edges 96 in FIG. 5 is taken up when the cam 50 is in its neutral position. Thus, once the adjustment is made to bring the cam axis 52 into parallel relationship with the centerline 28, further adjustment is not necessary, and all backlash, or freeplay, is removed from the leveling mechanism when the swashplate is in its zero displacement position.

It is furthermore noted that since springs 82 and 84 do not directly engage the swashplate 24, but only the cam contacts 66 and 68 positively center the swashplate 24, there are no problems with backlash as with the spring systems of previous designs. Furthermore, with the present invention, any change in spring characteristics during use, or improper adjustment of the spring at time of manufacture, does not cause tilting of the swashplate from its zero displacement position. In fact no spring adjustments are necessary with the present design even during later repair or spring replacement.

Another advantage of the present design is that the swashplate centering mechanism is located on the side cover of the housing to facilitate assembly separate from the assembly of the rotating block and swashplate within the housing 12 and from only one side of the housing. Thus multiple side covers or a complicated spring/servo assembly are avoided.

It can be seen that the present invention, as described above, meets the objectives of providing a compact, inexpensive, and easy assembly of a swashplate centering mechanism that has the further advantage of swashplate holddown where advantageous. The swashplate centering mechanism as specifically described are merely illustrating the preferred forms of practicing the present invention and are not intended to limit the scope of the present invention.

We claim:

1. A swashplate centering mechanism for a variable displacement hydraulic unit comprising a housing, a cylinder block rotatable in said housing about an axial centerline and having pistons axially movable therein, a swashplate tiltable about a transverse axis perpendicular to said centerline and having a cam surface engagable by said pistons to control the stroke of said pistons within said cylinder block, said centering mechanism comprising a cam member restrained for movement along a cam axis parallel to said centerline, said cam having a pair of spaced apart swashplate contact points one disposed on each side of said transverse axis, and biasing means biasing said cam member toward said swashplate whereby both of said cam contact points contact said swashplate when said swashplate is in a zero displacement position.

2. The swashplate centering mechanism of claim 1 wherein said hydraulic unit is reversible with said swashplate tilting in both directions about said transverse axis from a zero displacement position, said swashplate engaging only one of said cam contact points when said swashplate is tilted clockwise from the zero displacement position and engaging only the other of said cam contact points when said swashplate is tilted counterclockwise from the zero displacement position.

3. The swashplate centering mechanism of claim 1 wherein said cam contact points are in a plane perpendicular to said centerline and said swashplate has a planar surface which engages said contact points, said swashplate surface being perpendicular to said centerline when said swashplate is in the zero displacement position.

4. The swashplate centering mechanism of claim 1 wherein said swashplate is a cradle swashplate resting in bearing means at one end of said housing, said centering mechanism applying an axial biasing on said cradle swashplate causing said cradle swashplate to be firmly seated in said bearing means.

5. The swashplate centering mechanism of claim 4 wherein said leveling mechanism is located in said housing on one side of said cylinder block and a displacement control means attached to said swashplate is located in said housing on the opposite side of said cylinder block, said control means being mounted for axial movement parallel to said cam axis, separate biasing means applying an axial biasing force on said control means which cooperates in conjunction with said biasing means of said centering mechanism to further hold said cradle swashplate against said bearing means.

6. The swashplate centering mechanism of claim 5 wherein said biasing means for said centering mechanism comprises a pair of springs one on each side of said transverse axis and said biasing means for said control means comprises a single spring located on a line passing through said transverse axis.

7. The swashplate centering mechanism of claim 1 wherein the cam member has a leg portion parallel to said cam axis and a crossbar perpendicular to said cam leg and said transverse axis, said contact points being formed on said crossbar.

8. The swashplate centering mechanism of claim 7 wherein said housing has a side cover rotatable about an axis parallel to said swashplate transverse axis, said cam member leg being slidably mounted on said side cover whereby rotation of said side cover adjusts the parallel relationship of said cam axis and said centerline.

9. The swashplate centering mechanism of claim 7 wherein the cam member leg has a pair of axial slots, with said cam member being located relative to said housing by means of a pair of pins, one of said pins extending through each of said slots and wherein said pair of pins are located on said cam axis.

10. The swashplate centering mechanism of claim 9 wherein at least one of said pair of housing pins has an eccentric mounted for rotation relative to said housing to provide adjustment of said cam axis.

11. The swashplate centering mechanism of claim 4 wherein said biasing means comprises a pair of coil springs with one spring disposed on each side of said cam member leg and both of said springs engaging the said cam member crossbar.

12. The swashplate centering mechanism of claim 11 wherein said coil springs are of equal length when in a non-compressed state and wherein said housing has a transverse plane adjacent one end of said cylinder block opposite said swashplate, said housing plane has a pair of pockets with each pocket receiving said one end of one of said pair of springs, and wherein one of said pair of pockets is of greater depth than the other of said pair of pockets.

13. The swashplate centering mechanism for a variable displacement hydraulic unit comprising a housing, a cylinder block rotatable in said housing about an axial centerline and having pistons axially movable therein, a swashplate tiltable about a transverse axis perpendicular to said centerline and having a cam surface engageable by said pistons to control the stroke of said pistons within said cylinder block, the improvement comprising a centering mechanism having a cam member restrained for movement along a cam axis parallel to said centerline, biasing means biasing said cam member towards said swashplate, said cam member having a leg portion radially displaced from said centerline of said cylinder block by a distance greater than the radius of said cylinder block with said cam leg being mounted on a portion of said housing adjacent the side of said cylinder block, said cam member having a cross member with a pair of spaced apart swashplate contact points located one on each side of said cam leg, said pair of contact points being biased into engagement with said swashplate when such swashplate is in its zero displacement position.

14. The swashplate centering mechanism of claim 13 wherein said cam contact points engage said swashplate at a distance from said swashplate transverse axis approximately equal to the radius of said cylinder block.

15. The swashplate centering mechanism of claim 13 wherein said biasing means comprises a pair of axially located coil springs one on each side of said cam axis and with one end of each of said coil springs opposite said swashplate engaging said housing.

16. The swashplate centering mechanism of claim 15 wherein each of said coil springs are of equal length and spring rate when in a non-compressed state and wherein said coil springs are compressed to different lengths when said swashplate is in the zero displacement position.

17. The swashplate centering mechanism of claim 13 wherein said cam cross member is bent relative to said cam leg member with said cam contact points being spaced inwardly from said cam leg relative to the housing portion mounting said cam leg member.

18. The swashplate centering mechanism of claim 17 wherein said biasing means comprises a pair of coil springs, one of said springs engaging said cam cross member on each side of said cam leg, said springs being located radially outwardly from said cylinder block in corners formed by a rectangular housing cavity surrounding said cylinder block.

19. The swashplate centering mechanism of claim 13 wherein said cam leg portion is adjustably mounted on said housing by at least one rotatable mounting means rotatable about an axis parallel to said swashplate transverse axis whereby said cam axis may be adjusted into parallel relationship with said centerline.

20. The swashplate centering mechanism of claim 19 wherein said mounting means consist of a pair of pins extending from said housing with said pair of pins extending one each through a pair of slots formed on said cam leg, at least one of said pair of pins being eccentrically rotatably mounted on said housing for adjustment of said cam axis relative to said centerline to assure that both of said cam contact points engage said swashplate when said swashplate is in its zero displacement position.

21. The swashplate centering mechanism of claim 19 wherein said rotatable mounting means consists of a housing side cover rotatably adjustable relative to said housing said cam leg being axially slidable on said side cover whereby rotation of said side cover adjusts said cam line to assure that both of said cam contact points engage said swashplate when said swashplate is in its zero displacement position.

22. The swashplate centering mechanism of claim 21 wherein said side cover has parallel edges forming a slot, said cam leg being mounted in said slot for axial movement therein.

23. A swashplate holddown means for a variable displacement hydraulic unit comprising a housing, a cylinder block rotatable in said housing about an axial centerline and having pistons axially moveable therein, a swashplate tiltable about a transverse axis perpendicular to said centerline, bearing means on said housing supporting said swashplate, said swashplate having a cam surface engageable by said pistons to control the stroke of said pistons within said cylinder block, and a displacement control means operatively connected to said swashplate by linkage means to vary the tilt of said swashplate to control the axial position of said pistons in said cylinder block, the holddown means comprising mounting means locating said displacement control means on one side of said cylinder block and permitting axial movement parallel to said centerline of said linkage means attached to said swashplate, spring means axially biasing said linkage means toward said swashplate to apply a first axial biasing force on a first side of said swashplate, and a swashplate centering mechanism located on the opposite side of said cylinder block applying a second axial biasing force on said swashplate parallel to said first biasing force and on the opposite side of said swashplate.

24. The swashplate holddown means of claim 23 wherein such swashplate is a cradle swashplate supported by a pair of spaced apart arcuate roller bearings mounted on said housing and engaging said swashplate on arcuate surfaces formed on said swashplate on a face opposite said piston cam surface, said pair of bearings permitting tilting movement of said cradle swashplate about said transverse axis.

25. The swashplate holddown means of claim 24 wherein said centering mechanism comprises a cam member axially moveable along a cam axis parallel to said centerline, said cam having a pair of spaced apart swashplate contact points one disposed on each side of said transverse axis, and spring means biasing said cam member toward said swashplate whereby at least one of said contact points is always in an engagement with said swashplate.

26. The swashplate holddown means of claim 24 wherein said linkage means comprises a lever arm attached to said swashplate, pivot means located on said lever arm, control input means applying control forces to said lever arm to induce a tilting motion of said swashplate, and spring means applying an axial biasing force to said pivot means.

27. The swashplate holddown means of claim 26 wherein said lever arm is secured to said swashplate for tilting movement therewith about said transverse axis, said pivot means being located substantially on said transverse axis whereby said pivot means is subjected to at most limited movement due to control inputs to said lever arm.

28. The swashplate holddown means of claim 26 wherein said centering mechanism comprises a cam member axially moveable along a cam axis parallel to said centerline, said cam having a pair of spaced apart swashplate contact points, one disposed on each side of such transverse axis, and spring means biasing said cam member toward said swashplate whereby at least one of said contact points is in an engagement with said swashplate.

29. The swashplate holddown means of claim 28 wherein said cam member comprises the cam leg mounted for axial movement on said housing parallel to said centerline and a cross member perpendicular to said cam leg and including said spaced apart pair of contact points, said spring means comprising a pair of springs applying a biasing force to said cross member and located one on each side of said cam leg wherein said springs bias said cam member toward said cradle swashplate so that both said cam contact points contact said swashplate when said swashplate is in its zero displacement position.

* * * * *